US005218818A

United States Patent [19]

Ahmann

[11] Patent Number: 5,218,818

[45] Date of Patent: Jun. 15, 1993

[54] DEVICE FOR CONTROLLING A BY-PASS VALVE

[75] Inventor: Klaus-Peter Ahmann, Kernen, Fed. Rep. of Germany

[73] Assignee: Mercedes-Benz AG, Fed. Rep. of Germany

[21] Appl. No.: 872,424

[22] Filed: Apr. 23, 1992

[30] Foreign Application Priority Data

May 7, 1991 [DE] Fed. Rep. of Germany ..... 4114829

[51] Int. Cl.[5] ..... F01N 3/02

[52] U.S. Cl. ..... 60/286; 60/294; 60/303; 123/323

[58] Field of Search ..... 60/286, 294, 303; 123/323

[56] References Cited

U.S. PATENT DOCUMENTS

| | | | |
|---|---|---|---|
| 4,121,552 | 10/1978 | Mithuo | 123/323 |
| 4,205,639 | 6/1980 | Kawase | 123/323 |
| 4,380,149 | 4/1983 | Ludelke | 60/294 |
| 5,113,652 | 5/1992 | Baines | 60/288 |

FOREIGN PATENT DOCUMENTS

| | | | |
|---|---|---|---|
| 0424092 | 4/1991 | European Pat. Off. . | |
| 3408057 | 6/1985 | Fed. Rep. of Germany . | |
| 3428626 | 12/1988 | Fed. Rep. of Germany . | |
| 201309 | 8/1988 | Japan | 60/286 |
| 67013 | 3/1991 | Japan | 60/286 |

*Primary Examiner*—Douglas Hart

*Attorney, Agent, or Firm*—Evenson, McKeown, Edwards & Lenahan

[57] ABSTRACT

A device for regenerating a soot burn-off filter in an exhaust gas conduit of a diesel engine by means of a fuel/air mixture, part of which at least is ignited in the combustion space of at least one cylinder. The fuel/air mixture is guided out of the combustion space through a gas duct in the cylinder head, controlled by a by-pass valve, into the exhaust gas conduit upstream of the soot burn-off filter. The simple and low-cost device is suitable for reliable ignition of a soot burnoff filter located relatively far from the engine. The by-pass valve can be actuated by the driver in order to increase the engine braking power and can be driven into an open position by a control unit as a function of the parameters describing the regeneration phase.

8 Claims, 1 Drawing Sheet

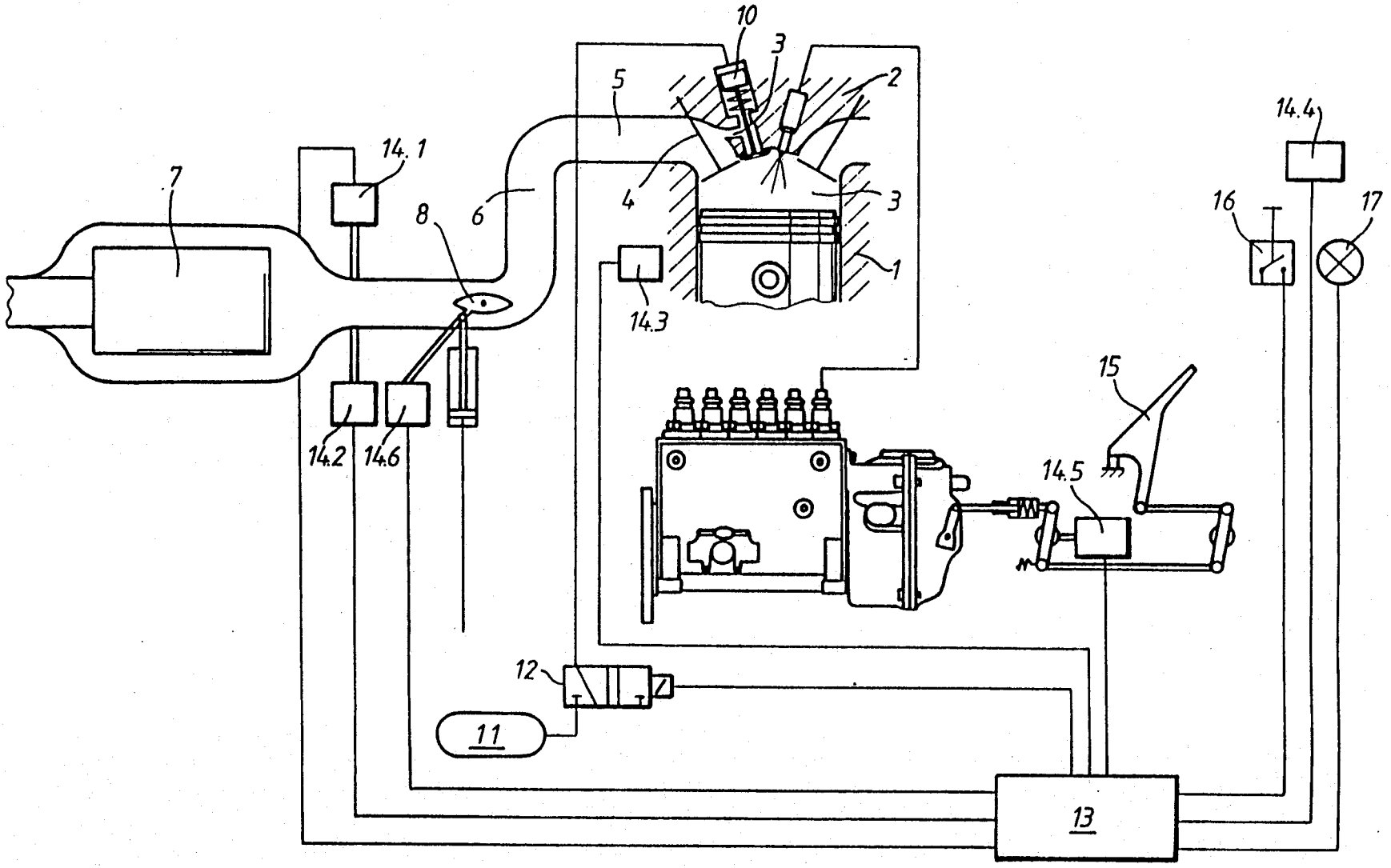
17
14.4
16
15
14.5
13
2
3
1
3
10
5
4
14.3
12
11
6
8
14.1
14.6
14.2
7

DEVICE FOR CONTROLLING A BY-PASS VALVE

BACKGROUND AND SUMMARY OF THE INVENTION

The invention concerns a device for controlling a by-pass valve in a diesel engine for driving a vehicle. The by-pass valve is located in a gas duct in the cylinder head of the diesel engine between a combustion space of at least one cylinder and an exhaust gas conduit upstream of a soot burn-off filter and from which, as a function of operating parameters of the diesel engine, a fuel/air mixture ignited in the combustion space can flow into the exhaust gas conduit to regenerate the soot filter.

A diesel engine with a by-pass duct between a combustion space and the exhaust gas installation is known from U.S. Pat. No. 4,380,149. In that arrangement, it is possible to open and close the by-pass duct by means of a solenoid valve and control takes place as a function of operating parameters. This by-pass duct, which is formed by a passage hole between the pre-combustion chamber and the exhaust manifold, permits ignited fuel-/air mixture to flow at high velocity directly into a soot filter located in the exhaust manifold after the solenoid valve has been opened and, by this means, ignites the soot particles which have collected in the soot filter. A disadvantageous feature, however, is that the device described can only be used for igniting a soot filter which is located directly in the immediate zone of action of the flame emerging from the by-pass duct, i.e. directly in the exhaust manifold. It is similarly disadvantageous that, in order to operate the device, an expensive solenoid valve which has to be opened for a short time at the moment of injection with exactly the cyclic frequency of the engine is necessary—together with a device for the corresponding control of the solenoid valve.

In diesel engines which have a throttle butterfly in the exhaust conduit as an engine brake device, it is also known from German Patent Document 34 28 626 to locate additional by-pass conduits between the combustion space and the exhaust gas conduit for a further increase in the engine braking power, it being possible to open and close each of the by-pass conduits by means of a fixed area throttle valve.

An object of the present invention is to provide a device for controlling a by-pass valve that in a simple and low-cost manner such that the by-pass valve can be used as an engine brake valve for engine braking operation in addition to being used as a control to initiate the regeneration of the soot burn-off filter.

This and other objects are achieved by the present invention which provides a device for controlling at least one by-pass valve in a diesel engine for driving a vehicle. The by-pass valve is located in a gas duct in a cylinder head of the diesel engine between a combustion space of at least one cylinder and an exhaust gas conduit upstream of a soot burn-off filter and from which, as a function of operating parameters of the diesel engine, a fuel/air mixture ignited in the combustion space can flow into the exhaust gas conduit to regenerate the soot filter. One by-pass valve is located on each cylinder head of the diesel engine and the by-pass valves are additionally drivable to increase the engine braking power. All the by-pass valves are driven into an open position in order to increase the engine braking power and, for regenerating the soot burn-off filter, only some of the by-pass valves are driven into an open position by a control unit as a function of parameters relating to regeneration phases of the soot burn-off filter.

Using a relatively simple and low-cost device, the present invention allows the by-pass valve to be used for regenerating the soot burn-off filter as a function of operating parameters, as well as for controlling the engine braking power.

Other objects, advantages and novel features of the present invention will become apparent from the following detailed description of the invention when considered in conjunction with the accompanying drawings.

BRIEF DESCRIPTION OF THE DRAWINGS

The single drawing FIGURE diagrammatically illustrates a device constructed in accordance with an embodiment of the present invention.

DETAILED DESCRIPTION OF THE DRAWINGS

The drawing shows a cylinder 1 with a cylinder head 2 of a 4-stroke diesel engine with direct injection installed in a motor vehicle for explanatory purposes. However, the present invention is equally applicable to diesel engines with different injection processes. In order to remove the exhaust gases from the cylinder 1, an exhaust duct 5 controlled by an exhaust valve 4 is connected to the combustion space 3 of the cylinder head 2. The exhaust duct 5 is connected to a soot burn-off filter 7 by means of an exhaust gas conduit 6. Also located in the exhaust gas conduit 6 is a throttle butterfly 8, which can be actuated mechanically or by means of additional equipment.

In addition to the exhaust duct 5, a gas duct 9 also leads off from the cylinder head 2 and emerges into the exhaust duct 5 or the exhaust gas conduit 6. This gas duct 9 can be opened or closed by means of a by-pass valve 10, it being possible to pneumatically actuate the by-pass valve 10 in association with a pressure reservoir 11 and a control valve 12 which is activated by an electronic control unit 13. Sensors 14 for recording and processing the parameters necessary for the regenerative phase or burn-off of the soot burn-off filter 7 and for increasing the engine braking power are connected to the electronic control unit 13. These can, for example, include one or more of the following: a pressure sensor 14.1 for recording the exhaust gas back pressure upstream of the soot burn-off filter 7; a temperature sensor 14.2 for recording the exhaust gas temperature, preferably at the inlet to the soot burn-off filter 7; a temperature sensor 14.3 for recording the engine temperature; a sensor 14.4 for recording the travelling speed of the motor vehicle; a sensor 14.5 for recording the position of the brake pedal 15; and a sensor 14.6 for recording the position of the throttle butterfly 8.

All the parameters relating to the actuation of the by-pass valve 10 are recorded by these sensors 14 and, by means of the control unit 13, are processed and converted into control signals to the control valve 12 and into signals to the driver.

The mode of operation of the device according to the present invention is as follows. In an engine braking operation, if the throttle butterfly 8 is closed, an increased engine braking power is achieved due to the rising exhaust gas back pressure. The closing of the throttle butterfly 8 is limited to overrun of the diesel engine, i.e. when the accelerator pedal 15 is brought to the zero position by the driver. In addition, the by-pass valve 10 can also be opened by a control instruction similarly initiated manually by means of a switch 16 on the control unit 13 so that the exhaust gas back pressure upstream of the throttle butterfly 8, and hence the engine braking power, is again substantially increased. Opening of the by-pass valve 10 during overrun with the throttle butterfly 8 open is prevented by the control unit 13.

In regenerating the soot burn-off filter 7, if the parameters necessary for regeneration of the soot burn-off filter 7, such as a correspondingly high degree of loading with soot particles, a minimum temperature of the exhaust gases and a load on the diesel engine demanding a minimum injection quantity, are satisfied, this condition is made known by means of a signal light 17 to the driver. The driver can now, by actuating the switch 16, manually open the by-pass valve 10 via the control unit 13.

It is therefore possible for the driver to initiate ignition immediately after recognition of the signal about the need to initiate regeneration or to delay it until a situation suitable for burning the soot particles arises, for example when away from inhabited areas. It is similarly possible to make the ignition dependent on attainment of a specified vehicle speed which is not permitted within built-up areas, or on its being exceeded, in order to exclude, as far as possible, the possibility of regeneration beginning in inhabited areas.

The actuated position in which the by-pass valve 10 is open and the throttle butterfly 8 is open leads to ignition of the soot burn-off filter 7 in compliance with the stated parameters are complied with because the fuel-/air mixture leads to a temperature exceeding the ignition temperature of the soot particles. At least part of the fuel/air mixture is ignited in the combustion space 3 of the cylinder head 2 and flows from the combustion space 3 through the open by-pass valve 10 and through the gas duct 9 into the exhaust gas conduit 6 and on into the soot burn-off filter 7. In this process the by-pass valve 10 remains open for several working strokes until such times as the soot burn-off filter 7 has, with certainty, ignited. In the case of non-compliance with the necessary parameters for ignition, ignition which would be initiated manually by means of the switch 16 is prevented by the control unit 13 because the by-pass valve 10 does not open.

The device according to the present invention is preferably installed and connected in such a way that a gas duct 9 with a by-pass valve 10 is installed on each cylinder of a multi-cylinder diesel engine for optimum increase in the engine braking power. If appropriate, however, only some of the total number of the gas ducts 9 are freed to initiate the regeneration of the soot burn-off filter 7.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A device for controlling at least one by-pass valve in a diesel engine for driving a vehicle, the by-pass valve being located in a gas duct in a cylinder head of the diesel engine between a combustion space of at least one cylinder and an exhaust gas conduit upstream of a soot burn-off filter and from which, as a function of operating parameters of the diesel engine, a fuel/air mixture ignited in the combustion space can flow into the exhaust gas conduit to regenerate the soot filter, wherein one by-pass valve is located on each cylinder head of the diesel engine and said by-pass valves are additionally drivable to increase the engine braking power, all the by-pass valves being driven into an open position in order to increase the engine braking power and, for regenerating the soot burn-off filter, only some of the by-pass valves are driven into an open position by a control unit as a function of parameters relating to regeneration phases of the soot burn-off filter.

2. A device for controlling at least one by-pass valve in a diesel engine for driving a vehicle, the by-pass valve being located in a gas duct in a cylinder head of the diesel engine between a combustion space of at least one cylinder and an exhaust gas conduit upstream of a soot burn-off filter and from which, as a function of operating parameters of the diesel engine, a fuel/air mixture ignited in the combustion space can flow into the exhaust gas conduit to regenerate the soot filter, wherein one by-pass valve is located on each cylinder head of the diesel engine and said by-pass valves are additionally drivable to increase the engine braking power, all the by-pass valves being driven into an open position in order to increase the engine braking power and, for regenerating the soot burn-off filter, only some of the by-pass valves are driven into an open position by a control unit as a function of parameters relating to regeneration phases of the soot burn-off filter;

the device further comprising a throttle butterfly which can be closed to increase the engine braking power and is located in the exhaust gas conduit, wherein the by-pass valve can be driven into an open position for a further increase in the engine braking power when the throttle butterfly is closed and when an accelerator pedal is in a zero load position.

3. The device according to claim 2, wherein the by-pass valve is drivable into an open position on attainment of all parameters necessary to initiate the regeneration of the soot burn off filter in order to initiate said regeneration.

4. The device according to claim 3, further comprising sensors for providing the parameters necessary to initiate the regeneration of the soot burn-off filter to be recorded and processed by the control unit.

5. The device according to claim 4, wherein manual actuation of the by-pass valve into an open position is prevented by the control unit when there is non-compliance with the necessary parameters.

6. The device according to claim 1, wherein the by-pass valve is drivable into an open position on attainment of all parameters necessary to initiate the regeneration of the soot burn-off filter in order to initiate said regeneration.

7. The device according to claim 1, further comprising sensors for providing the parameters necessary to initiate the regeneration of the soot burn-off filter to be recorded and processed by the control unit.

8. The device according to claim 1, wherein said control unit includes means for preventing manual actuation of the by-pass valve into an open position when there is non-compliance with the necessary parameters.

* * * * *